US008893797B2

(12) United States Patent
Aleksandrov

(10) Patent No.: US 8,893,797 B2
(45) Date of Patent: Nov. 25, 2014

(54) SELF-CONTAINED CUT-OFF DEVICE

(76) Inventors: Dmitriy Ivanovich Aleksandrov, St. Petersburg (RU); Pavel D. Aleksandrov, legal representative, St. Petersburg (RU)

( * ) Notice: Subject to any disclaimer, the term of this patent is extended or adjusted under 35 U.S.C. 154(b) by 33 days.

(21) Appl. No.: 13/880,244

(22) PCT Filed: Oct. 14, 2011

(86) PCT No.: PCT/RU2011/000802

§ 371 (c)(1),
(2), (4) Date: May 22, 2014

(87) PCT Pub. No.: WO2012/053935

PCT Pub. Date: Apr. 26, 2012

(65) Prior Publication Data

US 2014/0284044 A1 Sep. 25, 2014

(30) Foreign Application Priority Data

Oct. 18, 2010 (RU) ..... 2010142575

(51) Int. Cl.
*E21B 34/08* (2006.01)
*E21B 34/00* (2006.01)

(52) U.S. Cl.
CPC ..... *E21B 34/00* (2013.01); *E21B 2034/002* (2013.01)
USPC ..... 166/323; 166/332.1; 166/53

(58) Field of Classification Search
USPC ..... 166/53, 332.1, 323, 325, 373, 320; 137/527; 251/336
See application file for complete search history.

(56) References Cited

U.S. PATENT DOCUMENTS

| | | | | |
|---|---|---|---|---|
| 5,201,371 | A * | 4/1993 | Allen | 166/325 |
| 6,227,299 | B1 * | 5/2001 | Dennistoun | 166/332.8 |
| 7,216,668 | B1 * | 5/2007 | Adams | 137/462 |
| 7,287,596 | B2 * | 10/2007 | Frazier et al. | 166/332.8 |
| 8,439,118 | B2 * | 5/2013 | Myerley et al. | 166/332.8 |
| 8,544,549 | B2 * | 10/2013 | Noske et al. | 166/332.8 |

FOREIGN PATENT DOCUMENTS

| | | | |
|---|---|---|---|
| RU | 2160357 C2 | * | 12/2000 |
| RU | 2399821 C1 | * | 9/2010 |
| SU | 1099054 A | * | 6/1984 |

* cited by examiner

*Primary Examiner* — Daniel P Stephenson
(74) *Attorney, Agent, or Firm* — Alexander Robinovich

(57) ABSTRACT

A self-contained cut-off device for the use in oil and gas extraction comprises a body, a stop valve, a potential energy accumulator, and a hold-release arrangement. The arrangement, fixed in the body, is equipped with clamping elements. The valve comprises a drum-shaped valve head and a seat. The head outer surface has a conical groove for the clamping elements. On the inside, the head has a through passage for a flow with a conical portion expanding from the inlet to the outlet, and with a cylindrical portion at the outlet. The head comprises a replaceable nipple in the inlet of the passage. The seat comprises circulation passages in its annular part and has a boss made with a cylindrical surface and a spherical surface adapted to mate the cylindrical and conical portions of the passage, respectively. A sealed cavity for a lubricant is formed between the body and outer surface.

4 Claims, 1 Drawing Sheet

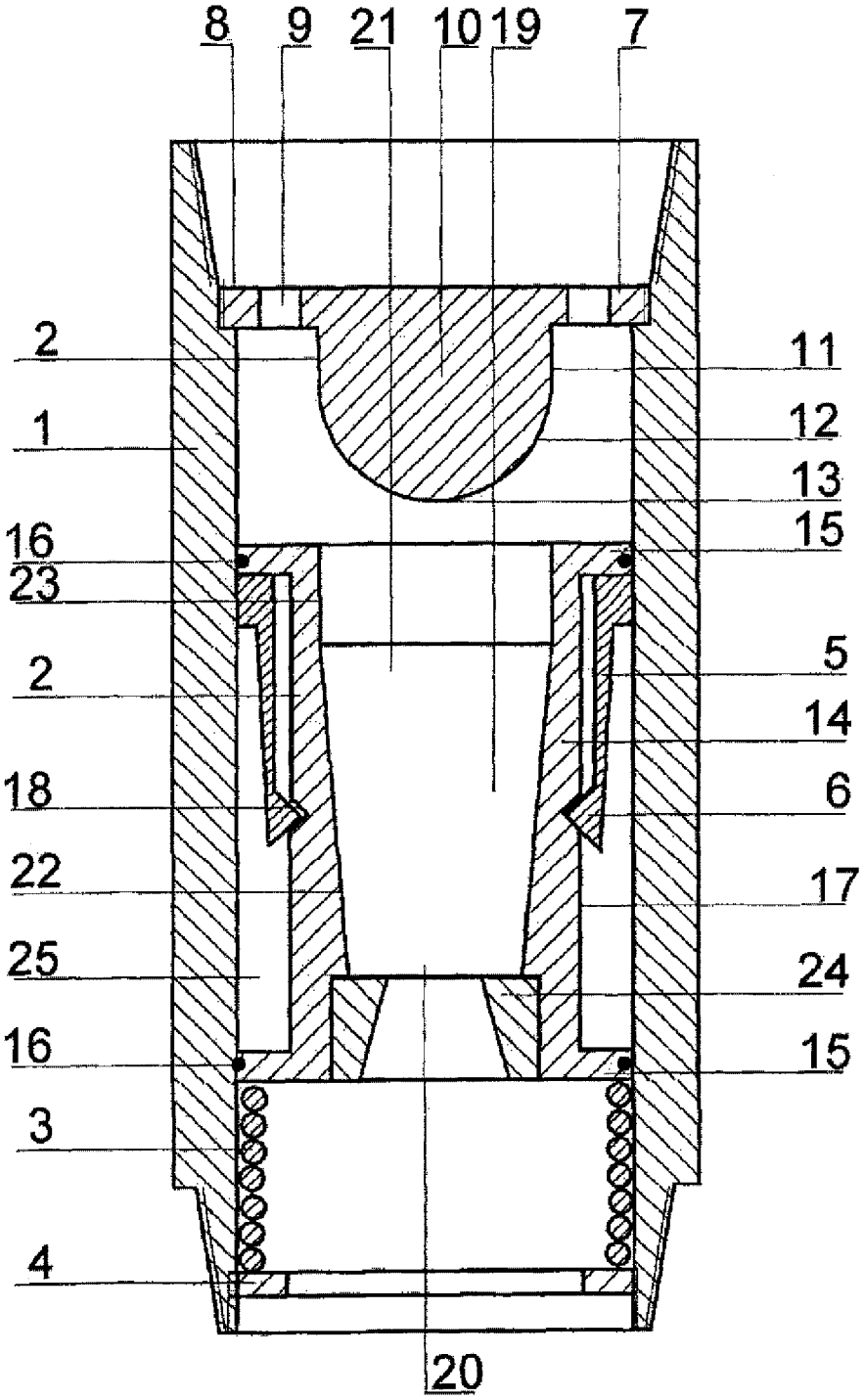
8
9
21
10
19
7
2
11
1
12
13
16
15
23
5
2
14
18
6
22
17
25
24
16
15
3
4
20

SELF-CONTAINED CUT-OFF DEVICE

TECHNICAL FIELD

The invention relates to the oil and gas extraction industry and can be used in the drilling and operating of various wells, and also in the construction and operation of surface pipeline systems.

PRIOR ART

Cutting valves are known, configured for leak-free shutoff of a wellbore when operating oil and gas wells, Russian Patent No. 2312203 C2, E21B34/06, 10.12.2007; Russian Patent No. 25527 U1, E21B34/06, 10.10.2002.

The cutting valve is known, comprising a body, where spring loaded ball valve with a seat, shifting tool interacting with a ball are located, Russian Patent No. 2191253 C1, E21B34/06, 24.01.2001; Russian Patent No. 2172815 C1, E21B34/06, 27.08.2001; Russian Patent No. 32183 U1, E21B34/06, 10.09.2003.

The cutting valve is known, comprising a body, a stop element with a spherical surface, spring for ponding the stop element, Russian Patent No. 2094593 C1, E21B34/06, F16K17/20, 27.10.1997.

The cutting valve is known, comprising the stop element in the form of a piston with a switching and fixation mechanism, Russian Patent No. 2145024 C1, E21B34/08, F16K17/34, 27.01.2000; Russian Patent No. 22174 U1, E21B34/06, F16K17/34, 10.03.2002.

The cutting valve is known, comprising gate in the form of a disc valve and gate drive, Russian Patent No. 2234595 C1, E21B34/10, 20.08.2004; Russian Patent No. 2160357 C2, E21B34/06, 10.12.2000; Russian Patent No. 2102582 C1, E21B34/06, 20.01.1998.

The cutting stationary straight-way valve is known that includes a body that incorporates a differential piston with a fixator and stop elements, a seat, a carrier pipe spacer and a spring loaded clap valve on the axis, designed with an option of clamping down to the seat in a position "closed", Russian Patent No. 2250354 C2, E21B34/06, 10.01.2005; Russian Patent No. 2293839 C1, E21B34/06, 20.02.2007.

A valve device is known, comprising a body, a stop element, designed in the form of plunger pair, or as a ball or a stock, either sphere or semi-sphere, and connected to executing mechanism in the form of silphon camera or a spring, engine, located to interact with executing mechanism, Russian Patent No. 2363835 C1, E21B34/06, 10.08.2009.

Cutting valves opening and closing are controlled by special instrument comprising drill and extracting column depending on works carried out.

The cutting valve is known, comprising a body, a stop element with a seat and a disc, fixator, Russian Patent No. 2311526 C2, E21B34/06, 27.11.2007.

The present technical solution is accepted as the closest analogue of the invention.

The closest analogue the body implementation is eccentric, the disc is spring loaded and is equipped with an additional starting spring, the ring fixator is spring loaded, the differential plunger interacts with the seat, the disc, and the ring fixator.

The closest analogue has a more complicated design, thus its reliability is compromised.

Upon closing its closure element, its reopening to resume the operational work is complicated.

The closest analogue design does not provide for the flow passing through with maximum normal intensity to be determined and necessary for a well of the particular (certain) diameter.

The cutting valve of the closest analogue cannot be widely used, for it is implemented to allow the flow with certain intensity thus limiting options for its usage.

DISCLOSURE OF THE INVENTION

The invention solves the problem to facilitate flow maximum normal intensity and to control the stop element closing and opening, thus improving the cut-off device reliability to safely carry out operational works and to widen its functional usage.

According to the invention, this task is solved via an implementation, when the Autonomous (self-contained) cut-off device comprises a body, a stop valve with the seat and the valve head, and the restrainer.

The device comprises a potential energy accumulator that is installed upon the stop ring in the body.

The device comprises a stop-release arrangement that is immovably fixed in the body and is equipped with clamping elements.

The valve head is designed in the form of a drum. The valve head in the form of a drum edges have gaskets.

The outer surface of the valve head in the form of a drum has a conical groove. The conical groove can interact with the clamping elements.

On the inside, the valve head in the form of a drum has a through passage for a flow with a surface of conical shape, which expands from the inlet to the outlet, and with a surface of cylindrical shape at the outlet.

The valve head comprises a replaceable valve nipple mounted at the through passage for a flow, on the inlet, and is coupled with the potential energy accumulator.

The seat comprises circulation passages on an annular part and has a boss.

The boss is formed by a cylindrical surface that may be coupled with a through passage for a flow of the cylindrical shape and a spherical surface with a spherical end that may be coupled with a through passage for a flow with a surface of conical shape at the outlet.

Herein, a lubricant-filled cavity is formed between the body and the valve head in the form of a drum outer surface.

The subject matter is characterized with a number of optional features, namely:

potential energy accumulator is in the form of a spring;

the lubricant-filled cavity is filled with a lubricant.

The applicant has no information from any source concerning the possible technical solutions identical to the device claimed.

The applicant assumes this determines the subject matter as matching the "novelty" criterion (N).

The particular technical result includes implementation of a cut-off device capable to let the flow pass in both directions, while recognizing automatically the flow increase above normalized, and automatically closing the through passage for a flow to be reopened upon the stop element reaching the initial position.

The technical result described does not result from any properties known thus, allowing, according to the applicant, considering the claimed technical solution as matching the criterion "inventive step" (IS).

The claimed technical solution implementation is confirmed by design and engineering work and preproduction series tests, the self-contained cut-off device uses parts and assemblies widely used in the oil and gas extraction industry, thus, according to the applicant, resulting in matching the "industrial applicability" criterion (IA).

BRIEF DESCRIPTION OF THE DRAWINGS

Further the claimed technical solution is explained by the description of its exemplary implementation with references to the attached drawing (FIG. 1), which illustrates an self-contained cut-off device, general view.

THE BEST EMBODIMENT OF THE INVENTION

The device comprises:
a body—1.
a stop valve (in a body 1)—2.
a potential energy accumulator (in a body 1)—3,
stop ring (for the accumulator 3)—4.
a stop-release arrangements (in a body 1)—5,
clamping elements (of the arrangement 5)—6.
a stop valve 2 includes:
a seat (of the valve 2)—7,
an annular part (of the seat 7)—8,
circulation passages (on an annular part 8)—9,
a boss (of the seat 7)—10,
a cylindrical surface (of a boss 10)—11,
a spherical surface (of a boss 10)—12,
spherical end (of a boss 9)—13.
valve head in the form of a drum (of the valve 2)—14,
edges (of the drum 14)—15,
gaskets (of edges 15)—16,
outer surface (of the drum 14)—17,
a conical groove (on the surface 17)—18,
through passage for a flow (inside the drum 14)—19,
inlet (of the passage 19)—20,
outlet (of the passage 19)—21,
a surface of conical shape (of the passage 19)—22,
a surface of cylindrical shape (of the passage 19)—23,
replaceable valve nipple (on the inlet 20)—24,
a lubricant-filled cavity (between a body 1 and a surface 17)—25.

The self-contained cut-off device comprises a body 1, a stop valve 2, a potential energy accumulator 3, and a stop-release arrangements 5.

The potential energy accumulator 3 is installed on the stop ring 4 in a body 1.

The potential energy accumulator 3 is in the form of a spring.

The stop-release arrangement 5 is immovably fixed in the body 1 and is equipped with clamping elements 6.

The stop valve 2 comprises a seat 7 and a valve head 14.

The valve head 14 is designed in the form of a drum with edges 15. The edges 15 have gaskets 16.

The outer surface 17 of the valve head 14 in the form of a drum has a conical groove 18. The groove 18 can interact with the clamping elements 6.

The lubricant-filled cavity 25 is formed between the body 1 and the outer surface 17 of the valve head 14 in the form of a drum for the stop-release arrangement 5. The lubricant-filled cavity 25 is filled with a lubricant.

On the inside, the valve head 14 in the form of a drum has a through passage for a flow 19. The through passage for a flow 19 has a surface of conical shape 22, which expands from the inlet 20 to the outlet 21. At the outlet 21 the through passage for a flow 19 has a surface of cylindrical shape 23.

The valve head 14 in the form of a drum comprises a replaceable valve nipple 24 mounted in the through passage for a flow 19, on the inlet 20. The valve head 14 in the form of a drum is coupled with a potential energy accumulator 3.

The seat 7 comprises circulation passages 9 on an annular part 8 and has a boss 10.

The boss 10 is formed by a cylindrical surface 11 and by a spherical surface 12, with a spherical end 13.

The cylindrical surface 11 may be coupled with a surface of cylindrical shape 23 of the through passage for a flow 19.

The spherical surface 12 may be coupled with a surface of conical shape 22 of the through passage for a flow 19, at the outlet 21.

The device works as follows.

The cut-off device is set in a well as a part of a drill column.

The cut-off device enables implementing direct and reverse flow circulation while the stop valve 2 is opened.

While operating the stop valve 2 is influenced by a system of powers:
Holding power—$P_y$,
Potential energy accumulator 3 (upwards)—$P_\pi$.
$P_y$ and $P_\pi$ values are defined while designing and manufacturing the device to satisfy the formula:

$$P_y > P_\pi,$$

where
$P_y$—holding power;
$P_\pi$—potential power.

While liquid passes through a replaceable valve nipple 24, pressure losses take place and, accordingly, the force that influences the stop valve 2, directed either way, depending on the flow direction.

On reverse circulation pressure loss results in a force that affects the stop valve 2, upwards ($P_B$).

Under normal circulation, the intensity, or layer fluid inflow, towards the stop valve 2, is affected by the normative force ($P_H$).

On direct circulation (pressurizing pipes downwards) with any intensity, no break of circulation flow within device takes place.

With reversed flow intensity above normal, then the stop-release arrangement 5 is engaged, to satisfy the formula:

$$P_B > P_H,$$

where
$P_B$—force resulting from pressure loss;
$P_H$—normative force.

Force ratio within the device must satisfy the condition:

$$P_y - P_\pi > \kappa P_H,$$

where
κ—safety factor (allowable increase of inflow in comparison to normative).

This formula provides for direct and reversed circulation within the device, lowered into well, to obtain layer fluids inflow with normative intensity.

With substantial exceeding liquid amount passing through the valve nipple 24 (more preferable with "κ" taken into account) pressure losses increase sharply, thus resulting in increase of force $P_B$, affecting the stop valve 2 upwards.

In the stop-release arrangement 5, affixed steadily within the body 1, the clamping elements 6 leave the conical groove 18 to free the valve head 14.

The valve head 14 influenced by potential energy released (and transformed into kinetic energy) of the accumulator 3, moves instantly ("shoots") into maximum up position, and herein the boss 10 of the seat 7, with its cylindrical surface 11, cuts off the through passage for a flow 19, leak-tight, (relative to a surface of cylindrical shape 23), with the remaining liquid to be removed via the circulation passages 9.

The cut-off device automatically "recognizes" emergency situation and, without waiting for a command from the outside, instantly closes the through passage for a flow 19.

The cut-off device is opened as follows.

Pipe space is pumped with liquid, with intensity slightly exceeding the one when the cut-off device is being closed. Herein, influenced by an effort within the replaceable valve nipple 24, resulting from pressure losses and directed downwards, the stop valve 2 moves into full-down position, and the potential energy accumulator 3 will be charged (spring is to be loaded), and the valve head 14 will be fixed with clamping elements 6 of the stop-release arrangement 5 and the stop valve 2 stays in operating state after gradual decrease of the flow intensity.

The device may be closed also via a command from the daylight surface, for example, before adding the drill column, while drilling with regulation of the differential pressure within well-layer system. To do so it is enough to increase the depression value, this resulting in a layer fluid inflow increase and the force ratio formula within the cut-off device ($P_y - P_\pi > \kappa P_H$) becomes invalid, thus resulting in the through passage for a flow 19 cutoff.

The cut-off device may be installed in the scroll bar of the well or in the drill column anywhere, herein the amount of the devices is not limited.

The cut-off device may be used at various surface pipelines, including those with reverse direction of the flow.

In this case, whenever necessary, it additionally is provided with a drive to open the valve.

The cut-off device reacts on "gradual" increase of the flow intensity via the valve nipple, i.e. in case of a break or other leakages within the pipeline through passage for a flow. Anyway, whenever the flow intensity exceeds the norm ($P_{BH}$), the flow losses rise, thus resulting in the stop valve release to cutoff the through passage for a flow.

An option to use the cut-off device installed into the well as a part of a drill column, or a scroll bar, or anywhere else, as well as its usage within various surface pipelines facilitates widening of its operational usage.

Usage of a replaceable valve nipple allows using the cut-off devices for various normal flows.

A well or any other object to be utilized may incorporate several cut-off devices, thus providing security improvement while carrying out technological operations.

The self-contained cut-off device design provides for maximum normal flow intensity, relatively to the well diameter, to be defined for each particular case.

Implementing the cut-off device with a potential energy accumulator and with stop-release arrangement facilitates direction control for the in-pipe flow thus improving reliability.

Providing the stop-release arrangements with the clamping elements provides the stop valve closing and opening, while the stop-release arrangement clamping in the body, improves the reliability of the cut-off device during operation.

Implementing the valve head in the form of a drum with edges provides the lubricant-filled space forming the lubricant-filled cavity that encloses the stop-release arrangement, thus resulting in improving the reliability of the cut-off device.

Providing the valve head with gaskets improves the sealing of the stop valve.

Implementing the valve head with a conical groove at its outer surface provides interaction between stop-release arrangements and the stop valve, allowing cutting off the through passage for a flow in case of emergency.

Placing inside the valve head the through passage for a flow with a surface of conical shape, which expands from the inlet to the outlet, facilitates maximum flow intensity passage both under normal operation and in emergency situation, and implementing the through passage for a flow with a surface of cylindrical shape at the outlet, facilitates reliable cutoff thereof in case of emergency.

Mounting a replaceable valve nipple in a valve head on the inlet to the through passage for a flow facilitates the stop valve triggering control and the flow motion management.

Implementing the seat with a boss maximizes the sealing effect of the stop valve while the accumulator moves towards full up position all the way to the valve head.

The boss with cylindrical and spherical surfaces and the an annular part near the seat facilitates (when the valve head and the seat couple) sealing by three sections: an annular part of the seat and the valve head, cylindrical surface of the boss and the through passage for a flow with a surface of cylindrical shape, spherical surface of the boss and the through passage for a flow with a surface of conical shape on the outlet (partly), thus improving reliability and facilitating sealing in cases of, for example, erosion destroying of one or another surface.

Spherical end provides flow redistribution thus improving the reliability of the cut-off device.

Filling the lubricant-filled cavity with a lubricant prevents any contaminants from getting in, to protect the stop-release arrangements against external influence, thus improving the reliability of stop-release arrangement operation as well as this of the entire cut-off device.

INDUSTRIAL APPLICABILITY

The proposed self-contained cut-off device uses parts and assemblies widely used in the oil and gas extraction industry, thus, according to the applicant, resulting in matching the "industrial applicability" criterion (IA).

What is claimed is:

1. A self-contained cut-off device comprising a body, a stop valve, a restrainer, a potential energy accumulator, and a hold-release arrangement, the accumulator being installed in the body on a base ring;

the hold-release arrangement being immovably fixed in the body and provided with clamping elements;

the stop valve comprising a valve head and a seat;

the valve head comprising:

a drum, whose edges are provided with gaskets, and whose outer surface has a conical groove adapted to interact with the clamping elements, and whose inside surface defines a through passage for a flow, the passage having a conical portion, which expands from an inlet to an outlet thereof, and a cylindrical portion at the outlet, into which cylindrical portion the conical portion merges, and a replaceable valve nipple mounted at the inlet of the through passage for a flow;

the valve head being coupled with the potential energy accumulator;

the seat comprising an annular portion, which is provided with circulation passages therein, and a boss comprising a cylindrical portion merging into a spherical portion with a spherical end, the cylindrical portion being adapted to mate the cylindrical portion of the passage of the drum, the spherical portion being adapted to mate the conical portion of the passage of the drum;

the hold-release arrangement being located in a hermetically sealed cavity formed between the body and the outer surface of the drum.

2. The device of claim 1, wherein the potential energy accumulator includes a spring.

3. The device of claim 1, wherein the hermetically sealed cavity is filled with a lubricant.

4. A self-contained cut-off device comprising a body, a stop valve, a restrainer, a potential energy accumulator, and a hold-release arrangement, the accumulator being installed in the body on a base ring;

the hold-release arrangement being immovably fixed in the body and provided with clamping elements;

the stop valve comprising a valve head and a seat;

the valve head comprising:

a drum, whose edges are provided with gaskets, and whose outer surface has a conical groove adapted to interact with the clamping elements, and whose inside surface defines a through passage for a flow, the passage having a conical portion expanding from an inlet to an outlet thereof and a cylindrical portion at the outlet, and a replaceable valve nipple mounted at the inlet of the through passage for a flow;

the valve head being coupled with the potential energy accumulator;

the seat comprising an annular portion, which is provided with circulation passages therein, and a boss comprising a cylindrical portion and a spherical portion with a spherical end, the cylindrical portion being adapted to mate the cylindrical portion of the passage of the drum, the spherical portion being adapted to mate the conical portion of the passage of the drum;

the hold-release arrangement being located in a hermetically sealed cavity formed between the body and the outer surface of the drum and filled with a lubricant.

* * * * *